US005304998A

United States Patent [19]

Lopez

[11] Patent Number: 5,304,998

[45] Date of Patent: Apr. 19, 1994

[54] DUAL-MODE COMMUNICATION ANTENNA

[75] Inventor: Alfred R. Lopez, Commack, N.Y.

[73] Assignee: Hazeltine Corporation, Greenlawn, N.Y.

[21] Appl. No.: 882,393

[22] Filed: May 13, 1992

[51] Int. Cl.[5] ..... H01Q 13/10

[52] U.S. Cl. ..... 343/767; 343/850

[58] Field of Search ..... 343/730, 820, 850, 767, 343/795, 797; 333/1.1, 24.2

[56] References Cited

U.S. PATENT DOCUMENTS

| | | | |
|---|---|---|---|
| 3,518,684 | 6/1970 | Brueckmann | 343/730 |
| 3,952,310 | 4/1976 | Griffee et al. | 343/730 |
| 4,982,197 | 1/1991 | Villaseca et al. | 343/792.5 |
| 5,038,151 | 8/1991 | Kaminski | 343/841 |

FOREIGN PATENT DOCUMENTS 1284727 8/1972 United Kingdom .

OTHER PUBLICATIONS

Johnson, R. C. & Jasik, H., *Antenna Engineering Handbook*, McGraw Hill, 1984, pp. 27-9 and 27-10.

*Primary Examiner*—Donald Hajec
*Assistant Examiner*—Tan Ho
*Attorney, Agent, or Firm*—E. A. Onders

[57] ABSTRACT

A compact wide-band panel antenna is modified to provide a dual-mode antenna system with improved operation, particularly in the presence of interfering signals and varying reception conditions in mobile communications applications. A hybrid junction arrangement is used to combine received signals in sum and difference modes suitable for adaptive processing. Signal transmission is provided by reciprocal operation, with a circulator incorporated for signal isolation. The dual mode capability provides previously unavailable performance in a small, economical broad-band antenna.

20 Claims, 7 Drawing Sheets

DUAL-MODE COMMUNICATION ANTENNA

This invention relates to antennas suitable for ground-based communication applications and particularly to a new form of dual-mode antenna suitable for mobile communication systems which may be subject to jamming in the presence of interfering signals.

One general type of antenna available in the prior art, which may be termed a panel antenna, consists of a reflecting screen with radiating elements, such as dipoles, mounted in front of the screen in a broadside configuration. Typically, such antennas use full-wavelength dipoles, half-wave dipoles, or slots as radiating elements. Attributes common to such antennas include: relative constancy of gain, radiation patterns and voltage standing wave ratio (VSWR) over a wide bandwidth of up to an octave; compact physical construction; very low coupling of radiated energy to the mounting structure; and low side lobes and rear lobes. Such antennas are described at pages 27-9 and 27-10 of the *Antenna Engineering Handbook*, R. C. Johnson and H. Jasik, McGraw Hill, Second Edition, 1984, and illustrated in FIGS. 27-3 and 27-4 thereof. One example illustrated, termed a skeleton slot antenna, includes a panel in the form of a rectangular metallic frame mounted in front of a square reflective back reflector. The antenna is excited by connecting each of the two conductors of a single feed line to one or more points along respective opposite sides of the rectangular metal frame. The physical form of the panel and back reflector of this prior skeleton slot antenna is similar to FIG. 1 of the present application, however, the feed, excitation, operation and other features to be described with reference to FIG. 1 differ from the *Handbook* antenna and description.

Antennas of a type different than the panel antennas referred to above are described in British patent specification 1,284,727. This patent shows and discusses antennas referred to as folded slot aerials which have the basic form of a conductive sheet with a rectangular opening and a slightly smaller rectangle of conductive material supported in front of the conductive sheet. The antenna is excited by connecting one conductor of a single feed line to the conductive sheet and the other conductor to one or more points along one side of the smaller conductive rectangle. The antennas of this patent may be precursors of the skeleton slot antenna shown in the above *Handbook*.

As shown and described in the Johnson/Jasik *Handbook*. these antennas have been found to provide significant operating advantages applicable to ground communication use, including small size, good radiation pattern and broadband operation. However, in such applications as mobile communication systems carried in motor vehicles and subject to operation within crowded frequency bands, useful operation may be affected by jamming and loss of message content in the presence of interfering, overlapping or reflected signals, with resulting loss of message intelligibility or data content.

It is therefore an object of the present invention to provide antennas capable of improved operation in the presence of interfering signals, while retaining the advantages of prior panel-type antennas.

It is a further object to provide simple, durable antennas of small size and good performance capable of providing reliable dual-mode performance in mobile communication and other applications.

Additional objects are to provide antennas with improved normal and difference mode signal reception characteristics which can be implemented by use of modifications to existing antenna designs, and new and improved antennas which provide performance or other benefits as compared to prior antennas.

SUMMARY OF THE INVENTION

In accordance with the invention, a dual-mode antenna system, including an antenna of the type wherein a generally rectangular conductive panel member having first and second sides is supported in front of a substantially planar back reflector having a width significantly greater than the panel member, utilizes first transmission line means, coupled to the first side of the panel member, for coupling a first received signal and second transmission lines means, coupled to the second side of the panel member, for coupling a second received signal. The antenna system includes signal combiner/divider means, coupled to the first and second transmission line means, for combining portions of the first and second received signals in a first phase relationship to provide a normal mode signal and for combining portions of such signals in a second phase relationship to provide a difference mode signal. Also included are: coupling means for selectively coupling signals; transmitter means, coupled to the signal combiner/divider means via the coupling means, for providing signals for transmission; and adaptive processing means, coupled to the signal combiner/divider means directly and via the coupling means, for interactively processing normal mode and difference mode signals to provide processed received signals. In accordance with the invention, the antenna system may also include receiver means, coupled to the adaptive processing means, for providing information signals from processed received signals, whereby recovery of information signals from received signals subject to interfering effects may be enhanced.

For a better understanding of the present invention, as well as other and further objects and features, reference is made to the following description taken in conjunction with the accompanying drawings and its scope will be pointed out in the appended claims.

DESCRIPTION OF THE INVENTION

Figure 1:
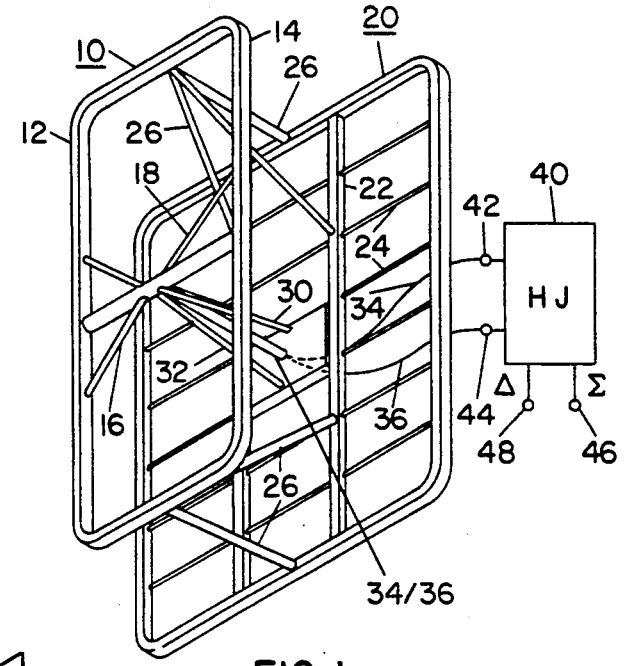
FIG. 1 shows a front perspective view of one form of dual-mode antenna in accordance with the present invention.
Figure 2:
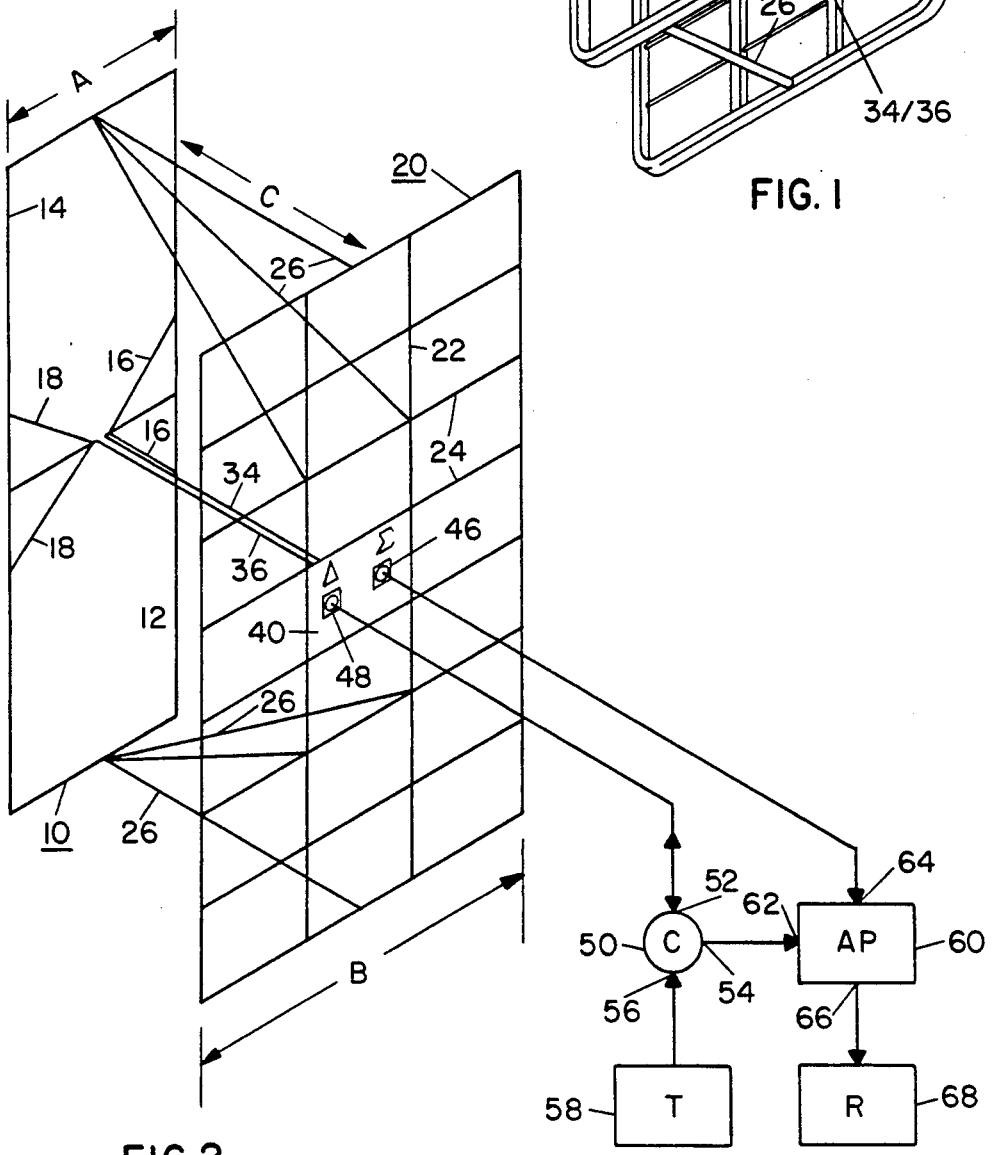
FIG. 2 is a simplified rear perspective view of a FIG. 1 type antenna, with inclusion of additional components of a dual-mode antenna system in accordance with the invention.

A front perspective view of a dual-mode antenna in accordance with the invention is shown in FIG. 1 and a simplified rear perspective view is shown in FIG. 2. As illustrated, the antenna includes a generally rectilinear panel member 10 supported in front of a planar back reflector 20. Panel member 10 in this embodiment is a rectangular metal tubular band or frame of circular or other cross-section having first and second side sections 12 and 14, which comprise spaced-apart straight portions of the frame 10. As shown, the panel member 10 also includes signal couplers 16 and 18. Signal coupler 16 comprises three conductive members for coupling signals to and from a point near the center of panel member 10 to three points spaced along side section 12. Correspondingly, signal coupler 18 connects to points along side section 14 Signal couplers 16 and 18 are shown as each coupling to three spaced points on the outer frame of panel member 10 in order to provide a signal coupling arrangement which enhances antenna bandwidth characteristics. In other applications, couplers 16 and 18 may each comprise only a single coupling path or a different configuration of multiple conductors may be used, as desired.

Back reflector 20, as shown, is constructed of a substantially square frame member of tubular metal having a circular or other cross-section, with vertical structural support members, such as shown at 22, and horizontal cross-conductors, such as wires or rods as shown at 24, which are spaced so as to provide a composite structure which acts as an essentially flat square reflective surface at operating frequencies, in well-known manner. As illustrated, panel member 10 is supported in front of back reflector 20 by support struts 26 arranged in a tripod configuration at each end of panel member 10. Struts 26 are arranged to provide required structural support, while causing only limited degradation of desired radiation pattern characteristics and any arrangement of one or more support members appropriate for this purpose may be utilized. As illustrated in FIG. 1, the antenna also includes diagonal conductive elements 30 and 32 connected to cross conductors 24 and proportioned to improve antenna radiation pattern characteristics as will be further discussed below. As indicated in FIG. 2, panel member 10 has a width A, which is narrower than width B of back reflector 20, and is spaced from back reflector 20 by spacing C. In a typical antenna operating at the lowest frequency within its intended frequency band, dimension A may be somewhat larger than one-fifth wavelength, dimension B may be about one-half wavelength and dimension C may be of the order of one-fifth wavelength. While back reflector 20 is shown as being square, the size and shape of the antenna elements may be selected as appropriate in particular applications.

As illustrated in FIG. 2, the antenna also includes first and second transmission line means, shown as coaxial lines represented as 34 and 36. First line 34 is coupled to the first side section 12 of panel member 10, via signal coupler 16. Second line 36 is correspondingly connected, via coupler 18, to second side section 14. Although shown as signal conductors, lines 34 and 36 are typically coaxial cables providing shielded connections to the signal couplers 16 and 18, with the outer conductors of the coaxial cables coupled to each other and to the back reflector 20. First and second lines 34 and 36 are effective to couple first and second received signals from the respective first and second sides of panel member 10. In practice, a tubular structural member may be provided, as shown as 34/36 in FIG. 1, as a conduit for transmission lines 34 and 36. Such conduit, while electrically isolated from couplers 16 and 18, may be connected to the ends of diagonal elements 30 and 32 shown extending from respective upper and lower points on cross conductors 24 of the back reflector 20, towards the termination of the conduit in the vicinity of the center of panel member 10. Diagonal elements 30 and 32 have been found effective as an aid in achieving desired antenna radiation pattern characteristics and may be found useful in the form illustrated or other configurations in other embodiments of the invention.

The embodiment of FIGS. 1 and 2 further includes signal combiner/divider means, shown as hybrid junction 40 mounted to the back of back reflector 20 in FIG. 2. Unit 40 may be any suitable form of hybrid junction, a circuit element of well-known characteristics. One example is the HJ/HJM-K Series of hybrid junction 0/180 degree Power Dividers/Combiners sold by Merrimac Inc. Such units are basically four port reciprocal devices. For signal reception, the two input ports 42 and 44 visible in FIG. 1 are coupled respectively to sides 12 and 14 of panel member 10. In this configuration signals from side sections 12 and 14 of panel member 10 will be combined in an out-of-phase relationship (plus/minus, for example) at the delta output port 48 of junction 40 and will be combined in an in-phase relationship (plus/-plus, for example) at the sigma output port 46. As will be further described, the hybrid junction 40 used in combination in the present antenna provides a normal mode signal at the delta output port 48 and a difference mode signal at the sigma output port 46. Thus, in the FIG. 1 antenna, normal mode terminal means 48 and difference mode terminal means 46, which may each typically be a coaxial cable connector, make available different relative combinations of received signals to enable adaptive or other signal processing. In addition, terminal means 48 and 46 are usable as hybrid junction input ports when the antenna is used for signal transmission on a reciprocal basis.

Referring now more specifically to FIG. 2, there is illustrated a dual-mode antenna system utilizing the FIG. 1 type antenna. As shown, the FIG. 2 system additionally includes coupling means, shown as circulator 50, coupled to hybrid junction 40, via port 48. Circulator 50 is a well-known type of circuit element effective to couple signals input at port 52 out at port 54 and to couple transmission signals input at port 56 out at port 52. By proper dimensioning of circulator 50 and phasing of internal signal coupling, signals entering at port 56 are substantially totally prevented from being coupled out at port 54 and correspondingly, received signals entering at port 52 are efficiently coupled to port 54 for further processing.

The FIG. 2 dual-mode system also includes transmitter means, shown as transmitter 58, for providing signals for transmission. In a mobile communication system, for example, information signals would be modulated on a carrier for transmission and provided to the normal mode terminal 48 (i.e., the delta input port of hybrid junction 40) via circulator 50

The antenna system as illustrated in FIG. 2 further includes adaptive processing means, shown as adaptive processor 60. Processor 60 is arranged to receive at input 64 difference mode signals from hybrid junction 40, via terminal 46, and to receive at input 62 normal mode signals from hybrid junction 40, via terminal 48 and circulator 50. FIG. 5 is a drawing indicating the relationship of input signals to adaptive processor 60. With reference to FIG. 5, it will be seen that the N curve represents the antenna pattern for the main beam representing the normal mode signal provided to input port 62 of adaptive processor 60 and the D curve represents the antenna pattern for the difference mode signal provided to input port 64 of processor 60. With normal and difference mode input signals of the type shown, those skilled in the field will be able to readily utilize available signal processing techniques, such as those commonly referred to as adaptive processing, and other forms of processing in order to enhance the recovery of information and data from received signals. Such techniques have been shown to enable operation in the presence of interfering signals and other effects experienced in signal transmission which cause jamming and other interference and which may excessively degrade operating performance for a single-mode system. For reference, such a single mode system would typically only provide a received signal in the form of curve N in FIG. 4, thereby foreclosing the availability of the advantages of adaptive processing to enhance performance. Previously, while forms of dual-mode operation were known in other applications, dual-mode operation was not possible in conjunction with a simple form of antenna and feed system such as provided in accordance with the invention.

The FIG. 2 system also includes receiver means, shown as receiver 68 connected to output port 66 of adaptive processor 60. Receiver 68 can be any appropriate form of receiver equipment suitable for further processing of signals to recover information, such as voice or data, in the form desired from the received signals.

OPERATION

As noted above, while it is well known that forms of dual-mode operation have previously been implemented in conjunction with sophisticated antenna systems incorporating complex feed arrangements, such as monopulse radar systems, dual-mode operation has not been available on a simplified basis with antennas of the type utilized in embodiments of the present invention. As compared to the waveguide implementation typical in a monopulse radar system, the unique implementation of a new dual-mode antenna capability in accordance with the present invention may be provided in a relatively simple manner once the invention is understood.

Figure 3A:
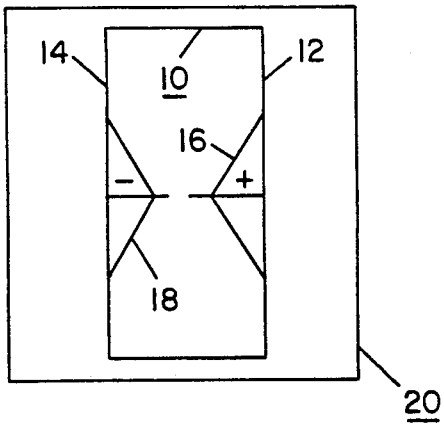
FIG. 3*a* and FIG. 3*b* are antenna representations showing relative signal phase in reception of normal mode signals.
Figure 3B:
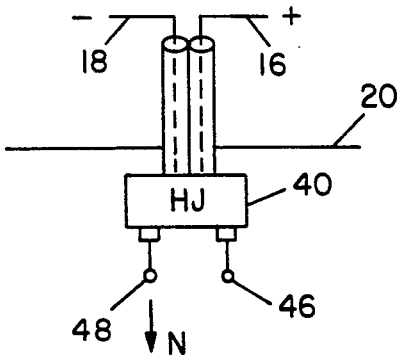

Referring now to FIGS. 3*a* and 3*b*, there is illustrated a simplified version of the FIG. 1 antenna, with certain features distorted or omitted for descriptive purposes. FIGS. 3*a* and 3*b* are respectively front and end views of such simplified antenna, with polarity signs indicative of relative signal phase during normal mode signal reception. Thus, referring to FIG. 3*b*, it will be seen that signals from the respective signal couplers 16 and 18 (respectively coupling signals from side sections 12 and 14 of panel member 10) are combined in an out-of-phase relationship to provide a normal mode signal at terminal 48. As represented in FIG. 3*b*, the two input ports (42 and 44 in FIG. 1) are directly connected to the respective signal couplers 16 and 18 by way of coaxial cables whose outer conductors are commonly connected to the back reflector 20. The coaxial cables connect to hybrid junction 40 and the normal mode signals are provided at output port 48 of junction 40, as previously described. As shown in FIG. 5, the result is the normal mode antenna pattern represented by curve N, with a main beam provided at approximately zero degrees, normal to the antenna.

Figure 4A:
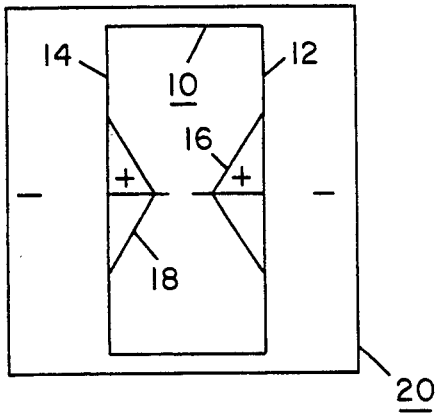
FIG. 4*a* and FIG. 4*b* are antenna representations showing relative signal phase in reception of difference signals.
Figure 4B:
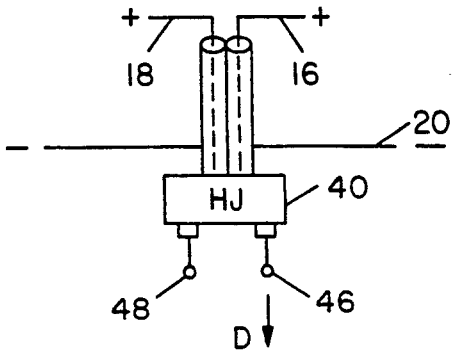
Figure 5:
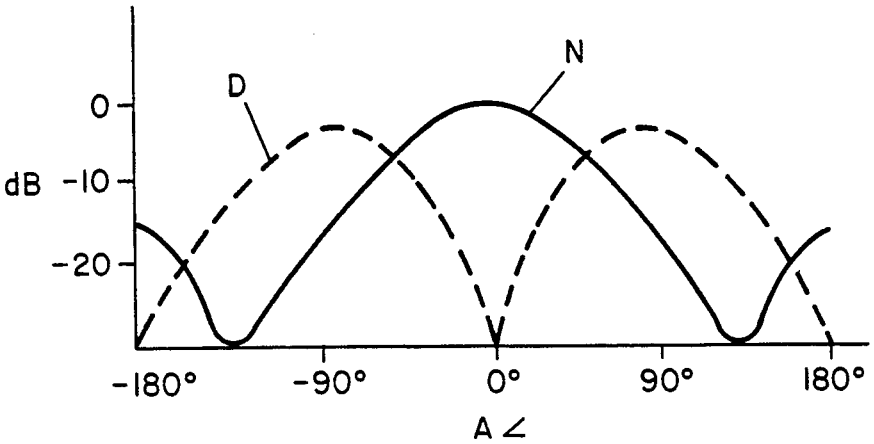
FIG. 5 shows the relationship between the normal mode and the difference mode.
Figure 6A:
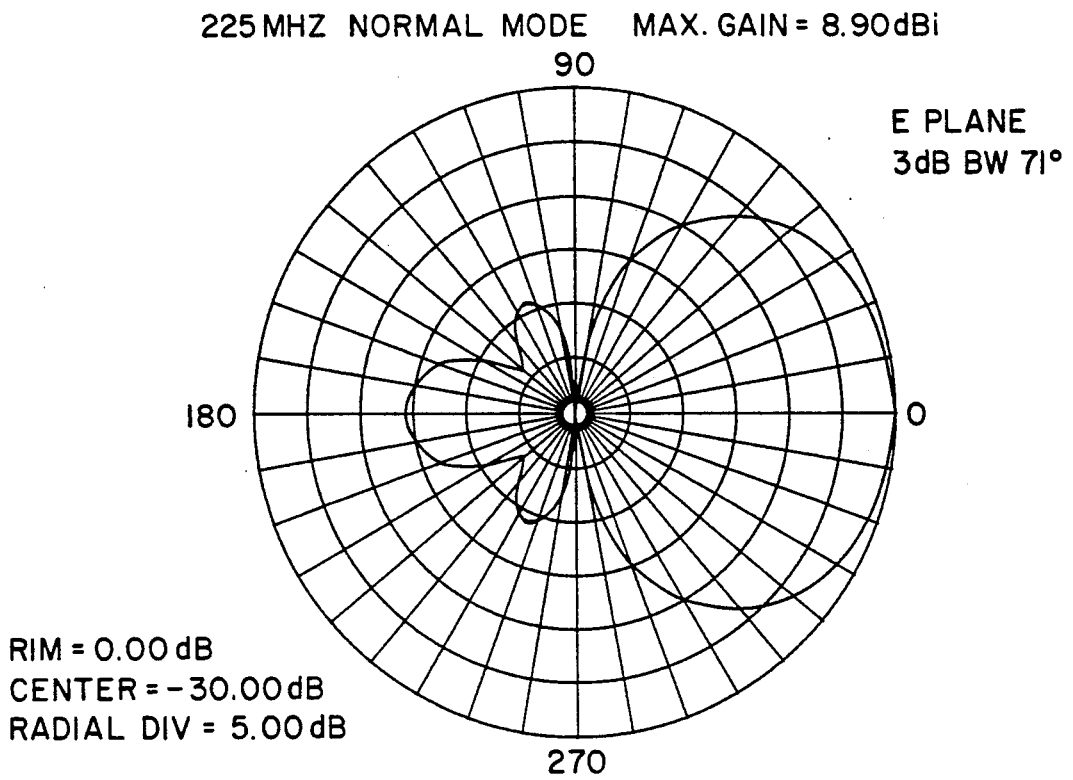
FIGS. 6*a*–6*f* and FIGS. 7*a*–7*c* are computer-generated radiation patterns for a FIG. 1 type antenna.
Figure 6B:
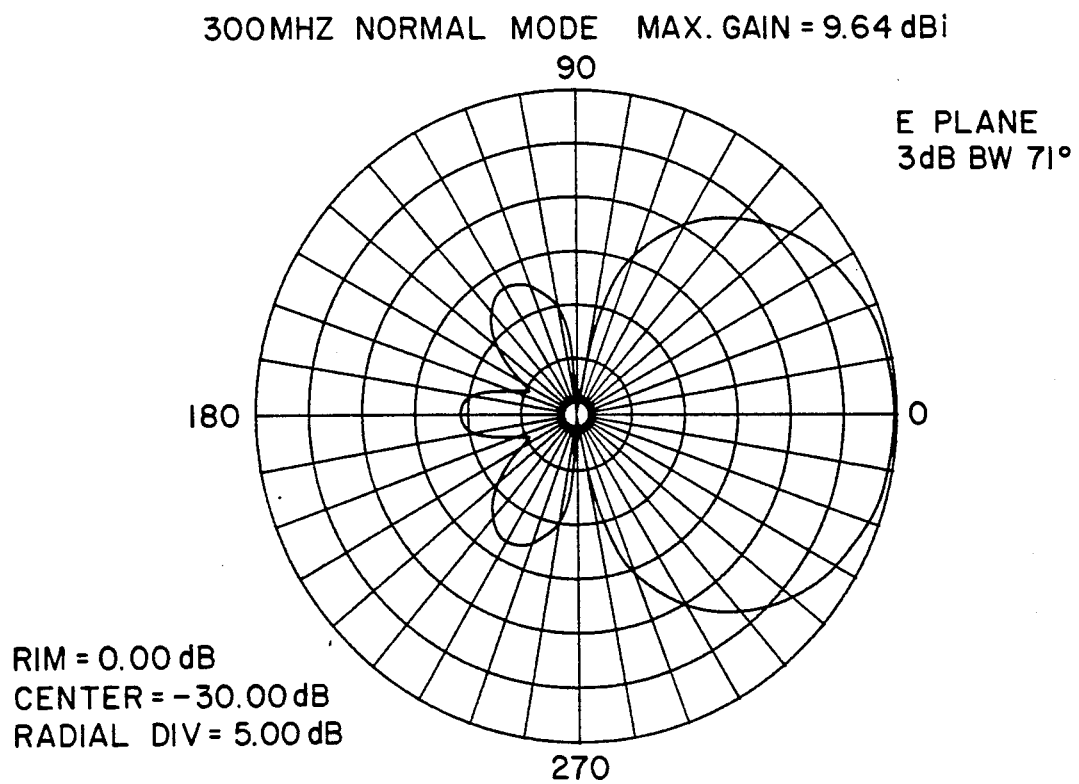
Figure 6C:
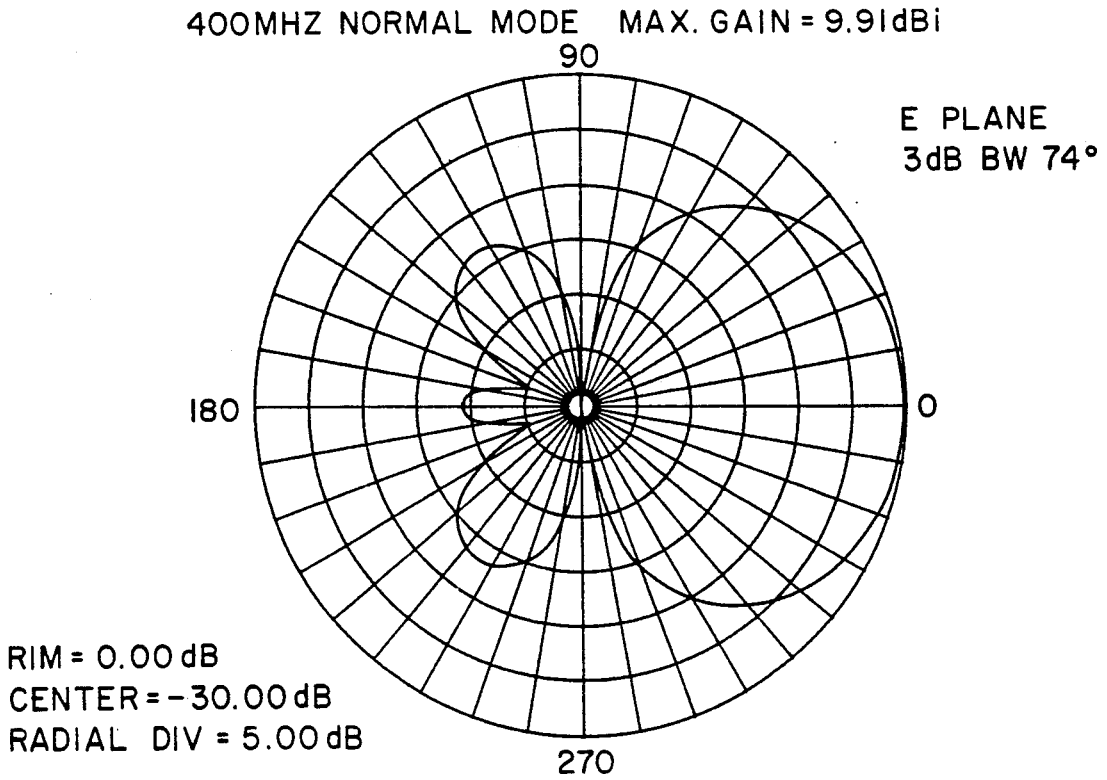
Figure 6D:
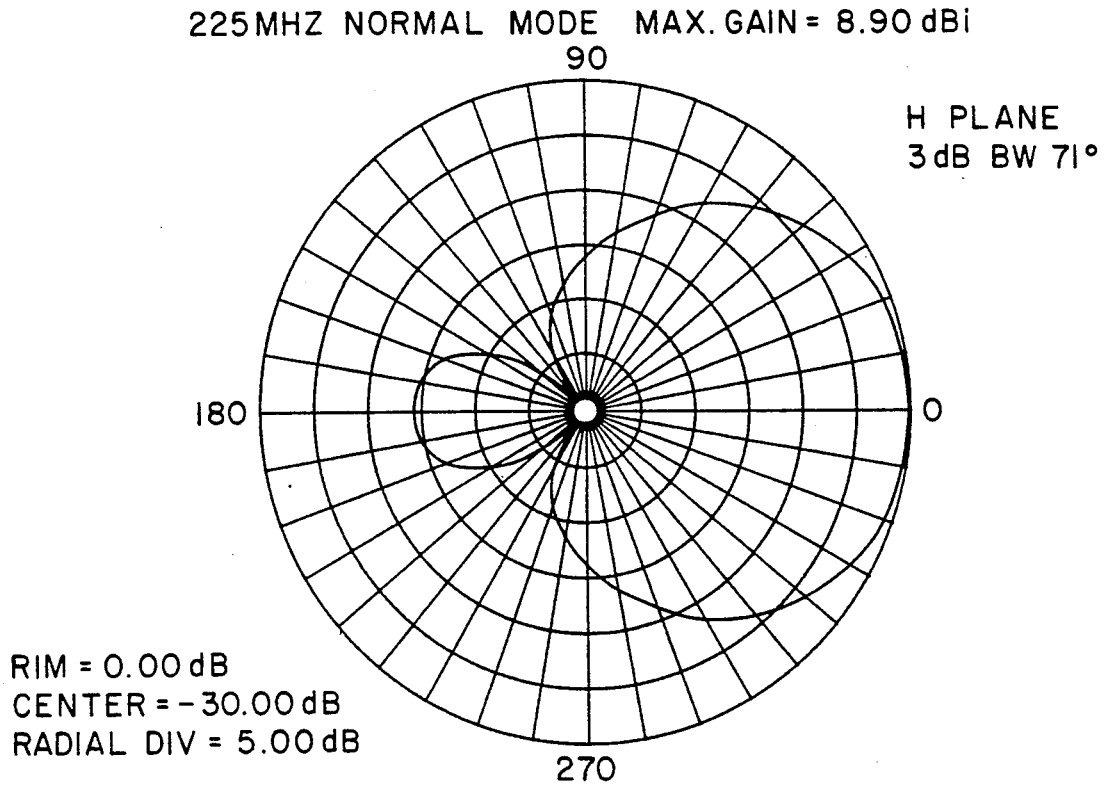
Figure 6E:
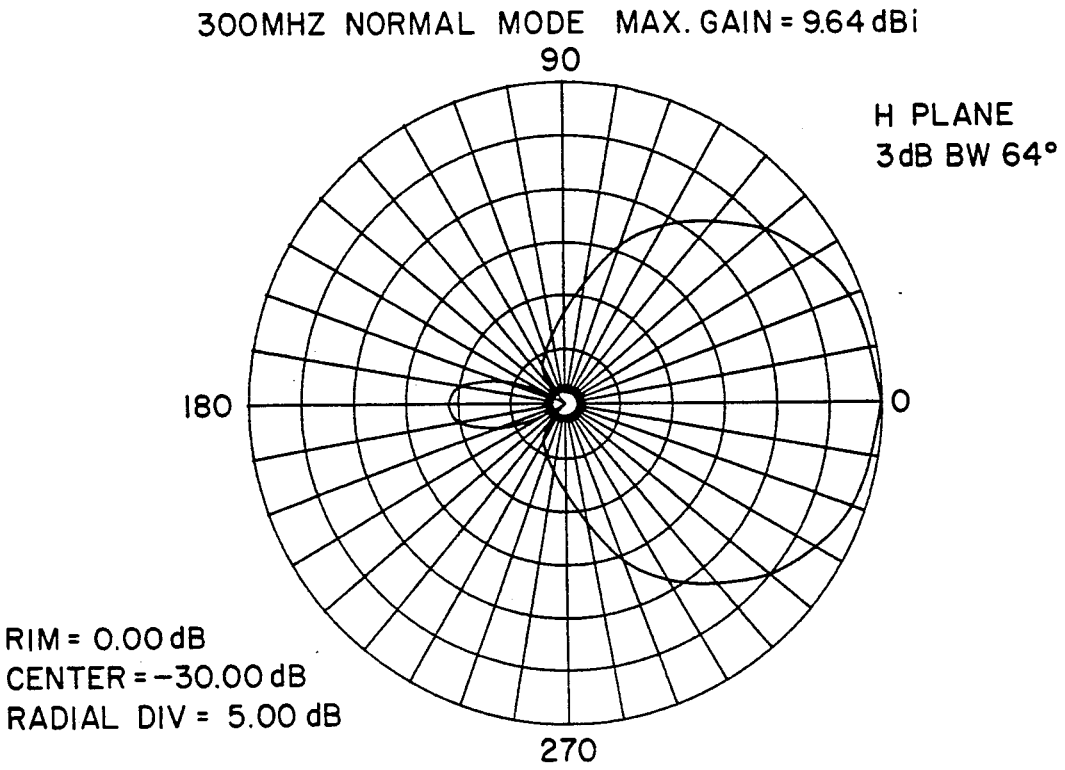
Figure 6F:
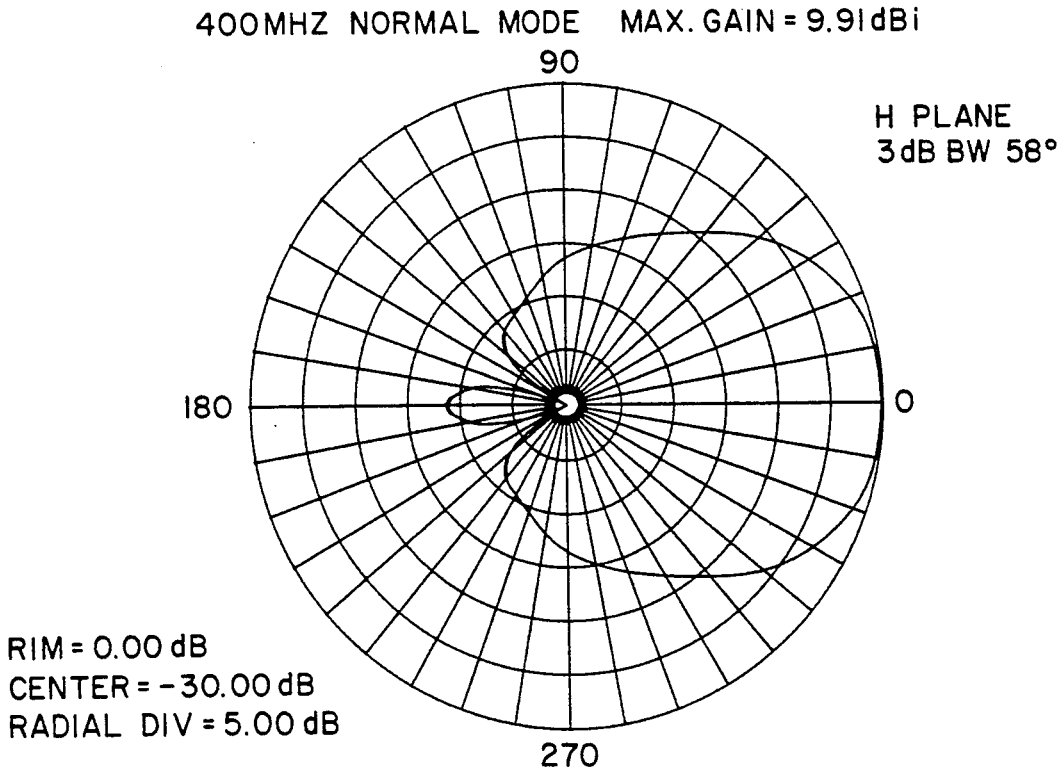

FIGS. 4*a* and 4*b* correspondingly show polarity signs indicative of relative signal phase characteristic during difference mode signal reception. Thus, in FIG. 4*b* it will be seen that signals from side sections 12 and 14, coupled via couplers 16 and 18, are combined in an in-phase relationship to provide a difference mode signal at terminal 46. As shown in FIG. 5, the result is the difference mode antenna pattern represented by the dashed curve D, having a center null characteristic.

As referred to above, the normal mode and difference mode signals thus provided may be coupled to additional elements as shown and described with reference to FIG. 2. With the normal mode signal coupled from terminal 48 via circulator 50 and the difference mode signal coupled from terminal 46 (with any necessary delay equalization provided in known manner), adaptive processor 60 is enabled to provide interactive processing of the normal mode and difference mode signals so as to effectively discriminate against jamming signals or other interfering effects degrading signal reception in order to enhance the recovery of information signals which may include voice messages or other data. The result is that, in operation of a mobile land communication system operating under variable transmission conditions in a crowded frequency spectrum, the system may be enabled to successfully receive messages not otherwise discernable.

Figure 7A:
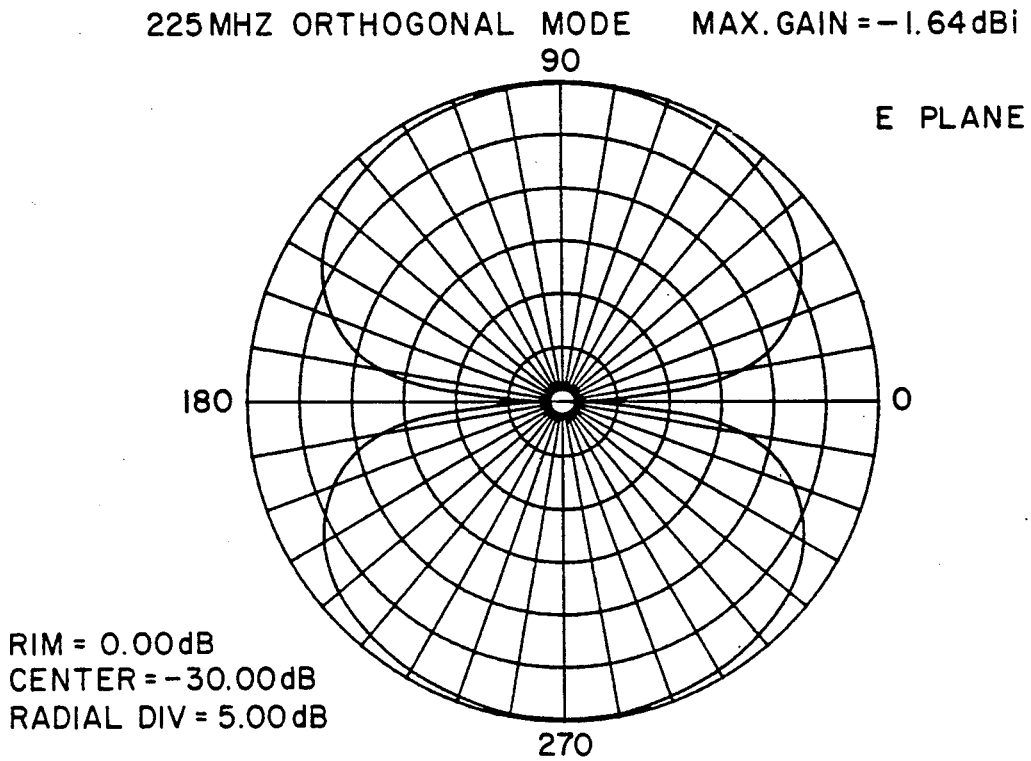
Figure 7B:
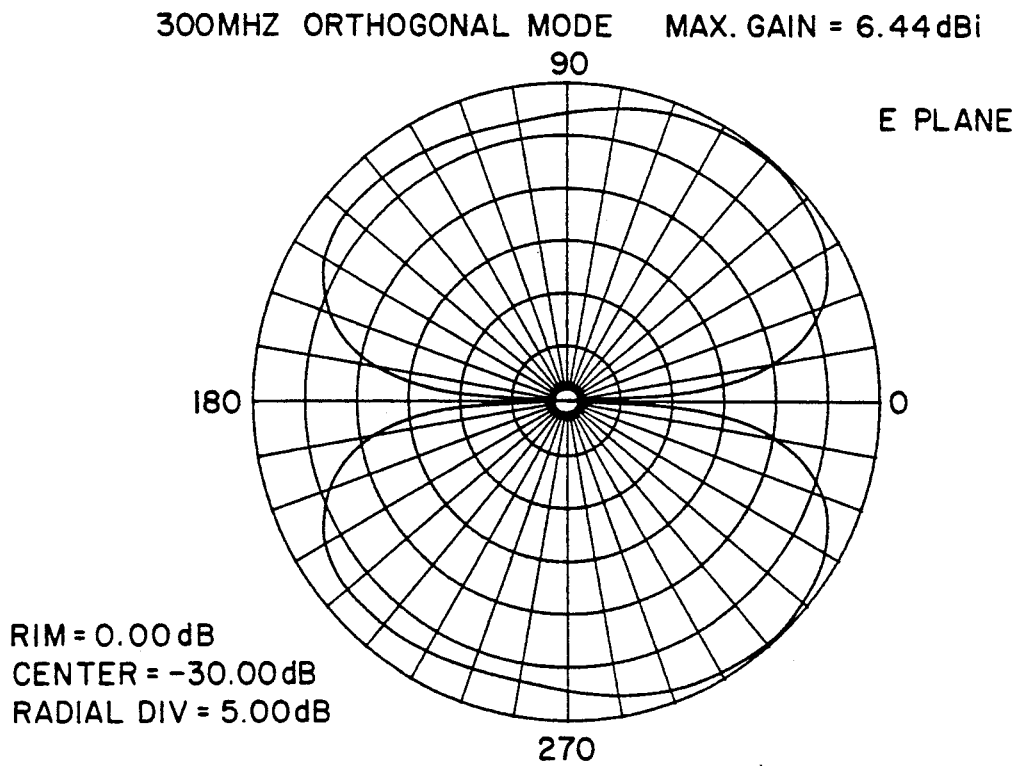
Figure 7C:
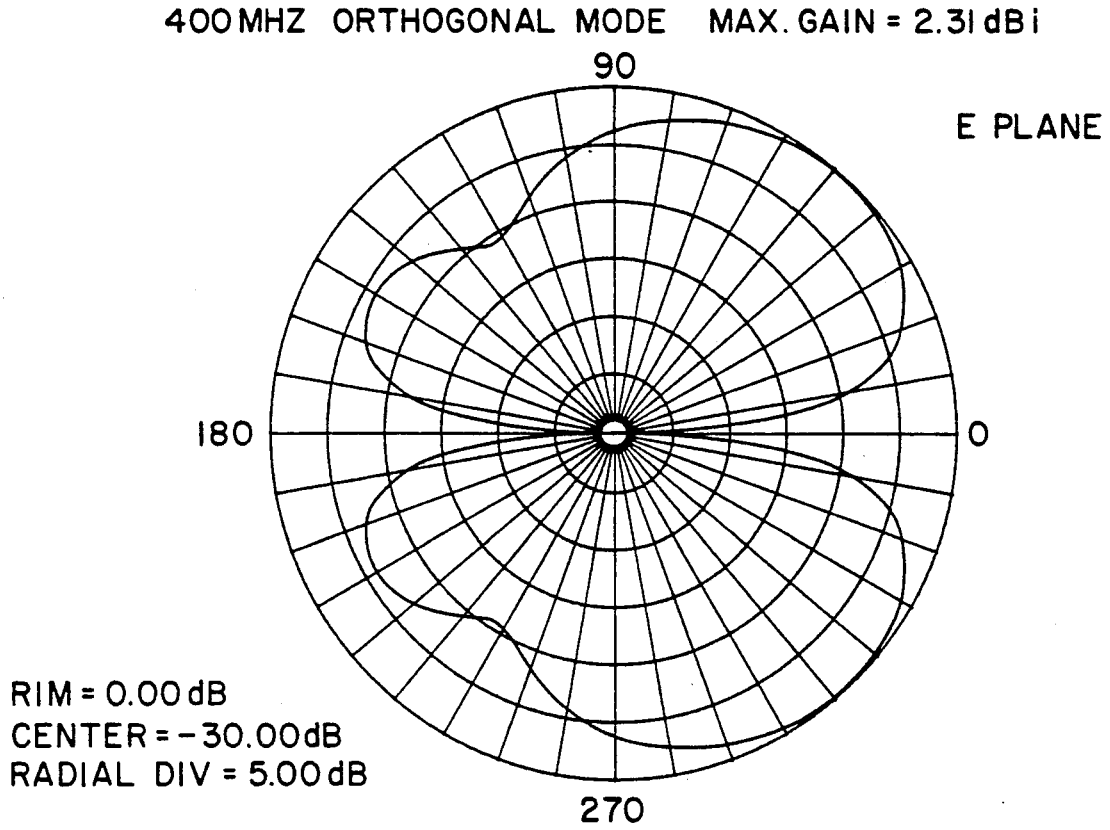

FIGS. 6*a*–6*c* and FIGS. 6*d*–6*f* show, for frequencies of 225, 300 and 400 megahertz (as labelled), E plane antenna patterns and H plane antenna patterns illustrating computer generated normal mode radiation characteristics of the FIG. 1 form of antenna. With reference to the forward focused main beam as determined for the E plane, it will be apparent that additional optimization using known antenna design techniques may be desirable to achieve a reduction of antenna sensitivity outside of the main beam. Such normal aspects of antenna design are not directly relevant to results achieved with the invention, as further illustrated in FIGS. 7*a*–7*c* In FIGS. 7*a*–7*c* there are included 225, 300 and 400 megahertz E plane antenna patterns illustrating computer generated difference mode radiation characteristics of the FIG. 1 form of antenna. The center null and gain characteristics of the difference mode patterns provide the basis for improved operation through use of adaptive signal processing.

While there have been described the currently preferred embodiments of the invention, those skilled in the art will recognize that other and further modifications may be made without departing from the invention and it is intended to claim all such modifications as fall within the full scope of the invention. In particular, while the invention has been described in relation to one form of antenna construction, it will be apparent that the invention is also applicable to antennas of other appropriate dimensions and forms, whether implemented through printed circuit technology, with discrete elements or otherwise, for particular or general applications.

What is claimed is:

1. In an antenna of the type wherein a panel member in the form of a continuous metallic band having first and second opposed side sections is supported in front of a substantially planar back reflector having a width greater than said panel member, the improvement enabling dual-mode operation, comprising:

first transmission line means, coupled to said first side section of said panel member, for coupling a first received signal;

second transmission line means, coupled to said second side section of said panel member, for coupling a second received signal;

signal combiner/divider means, coupled to said first and second transmission line means, for combining portions of said first and second received signals in a first phase relationship to provide a received normal mode signal and for combining portions of said first and second received signals in a second phase relationship to provide a received difference mode signal; and normal mode and difference mode terminal means, coupled to said signal combiner/divider means, for respectively coupling said received normal mode and received difference mode signals to enable processing of said signals, and for selectively coupling input signals to enable use of said antenna on a reciprocal basis for dual-mode reception and transmission of signals.

2. An antenna as described in claim 1, wherein said signal combiner/divider means is a microwave hybrid junction.

3. An antenna as described in claim 2, wherein a difference port of said hybrid junction is utilized to provide said normal mode signal and a sum port of said hybrid junction is utilized to provide said difference mode signal.

4. An antenna as described in claim 1, wherein said panel member is a continuous metallic band of generally rectilinear shape and said first and second transmission line means are coaxial cables respectively connected to said first and second side portions of said panel member at least one points with the outer conductors of said coaxial cables connected to said back reflector.

5. An antenna as described in claim 1, wherein said antenna is arranged for operation with horizontal polarization within a band of approximately 225 to 400 megahertz, and said panel member and said back reflector are each approximately one-half wavelength high, at a frequency near the lower end of said band, and said panel member is narrower that said back reflector.

6. An antenna as described in claim 5, additionally comprising means for adjusting radiation pattern characteristics, in the form of diagonal conductive elements extending from respective upper and lower points on said back reflector towards points in the vicinity of the center of said panel member.

7. An antenna as described in claim 1, additionally comprising adaptive processing means, coupled to said normal mode and difference mode terminal means, for interactively processing said received normal mode signals and received difference mode signals to enable improved message reception from received signals in the presence of signals tending to interfere with such reception.

8. A dual-mode antenna system, including an antenna of the type wherein a generally rectangular conductive panel member having first and second sides is supported in front of a substantially planar back reflector having a width significantly greater than said panel member, comprising:

first transmission line means, coupled to said first side section of said panel member, for coupling a first received signal;

second transmission line means, coupled to said second side section of said panel member, for coupling a second received signal;

signal combiner/divider means, coupled to said first and second transmission line means, for combining portions of said first and second received signals in a first phase relationship to provide a normal mode signal and for combining portions of said first and second received signals in a second phase relationship to provide a difference mode signal;

coupling means, coupled to said signal combiner/divider means, for selectively coupling signals;

transmitter means, coupled to said signal combiner/divider means via said coupling means, for providing signals for transmission by said antenna;

adaptive processing means, coupled to said signal combiner/divider means directly and via said coupling means, for interactively processing said normal mode signals and difference mode signals to provide processed received signals; and receiver means, coupled to said adaptive processing means, for providing information signals from said processed received signals, whereby recovery of information signals from received signals subject to interfering effects may be enhanced.

9. An antenna system as described in, claim 8, wherein said signal combiner/divider means is a microwave hybrid junction.

10. An antenna system as described in claim 9, wherein a difference port of said hybrid junction is utilized to provide said normal mode signal and a sum port of said hybrid junction is utilized to provide said difference mode signal.

11. An antenna system as described in claim 10, wherein said coupling means is a microwave circulator device coupled between said difference port and said transmitter means and also coupled to said adaptive processing means.

12. An antenna system as described in claim 8, wherein said panel member is a continuous metallic band of generally rectilinear shape and said first and second transmission line means are coaxial cables respectively connected to said first and second side portions of said panel member at least one points, with the outer conductors of said coaxial cables connected to said back reflector.

13. An antenna system as described in claim 8, wherein said antenna is arranged for operation with horizontal polarization within a band of approximately 225 to 400 megahertz, and said panel member and said back reflector are each approximately one-half wavelength high, at a frequency near the lower end of said band, and said panel member is narrower than said back reflector.

14. An antenna system as described in claim 13, additionally comprising means for adjusting radiation pattern characteristics, in the form of diagonal conductive elements extending from respective upper and lower points on said back reflector towards points in the vicinity of the center of said panel member.

15. An anti-jam radio communication system, comprising:

a back reflector having a substantially planar reflective surface with height and width dimensions of approximately one-half wavelength at a frequency in an operating frequency band;

a conductive member having the form of a substantially rectangular metallic band with right and left side portions and a width substantially smaller than one-half wavelength at a frequency in an operating frequency band;

a first coaxial transmission line, coupled to said left side portion of said conductive member and having an outer conductor coupled to said back reflector, for coupling a first received signal;

a second coaxial transmission line, coupled to said right side portion of said conductive member and having an outer conductor coupled to said back reflector, for coupling a second received signal;

hybrid junction means, coupled to said first and second transmission lines, for combining portions of said first and second received signals in a first polarity relationship to provide a normal mode signal and for combining portions of said first and second received signals in a reverse polarity relationship to provide a difference mode signal; and adaptive processing means, coupled to said hybrid junction means, for interactively processing said normal mode and difference mode signals to provide processed received signals.

16. A communication system as described in claim 15, wherein said system is arranged for operation with horizontal polarization within a band of approximately 225 to 400 megahertz, and said panel member is approximately one-fifth wavelength wide and spaced from said back reflector by approximately one-fifth wavelength, at a frequency in the lower portion of said band.

17. A communication system as described in claim 16, additionally comprising means for adjusting radiation pattern characteristics, in the form of diagonal conductive elements extending from respective upper and lower points on said back reflector towards points in the vicinity of the center of said conductive member.

18. A communication system as described in claim 15, additionally comprising a microwave circulator device, coupled between said hybrid junction means and said adaptive processing means, for coupling said normal mode signal.

19. A communication system as described in claim 18, additionally comprising transmitter means, coupled to said microwave circulator device, for providing signals for transmission by said communication system.

20. A communication system as described in claim 19, additionally comprising receiver means, coupled to said adaptive processing means, for providing information signals from said processed received signals, whereby an anti-jam capability provided by s id interactive processing of said normal mode and difference mode signals enhances signal reception.

* * * * *